US008797374B2

(12) United States Patent
Inagaki

(10) Patent No.: US 8,797,374 B2
(45) Date of Patent: Aug. 5, 2014

(54) IMAGE FORMING APPARATUS WITH A CONTROL UNIT FOR CONTROLLING LIGHT INTENSITY OF A BEAM USED TO SCAN A PHOTORECEPTOR

(75) Inventor: Yoshihiro Inagaki, Hachioji (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 181 days.

(21) Appl. No.: 13/361,059

(22) Filed: Jan. 30, 2012

(65) Prior Publication Data

US 2012/0195609 A1 Aug. 2, 2012

(30) Foreign Application Priority Data

Feb. 1, 2011 (JP) ..... 2011-019781

(51) Int. Cl.
*B41J 2/47* (2006.01)
*G03G 15/043* (2006.01)

(52) U.S. Cl.
CPC ..... *G03G 15/043* (2013.01); *G03G 2215/0404* (2013.01)
USPC ..... 347/251; 399/51

(58) Field of Classification Search
CPC ..... G03G 15/043; G03G 2215/0404
USPC ..... 347/251, 131; 382/260; 399/51
See application file for complete search history.

(56) References Cited

U.S. PATENT DOCUMENTS

| | | | | |
|---|---|---|---|---|
| 5,398,124 | A | 3/1995 | Hirota | |
| 6,292,205 | B1 * | 9/2001 | Nakayasu et al. | 347/131 |
| 2009/0073495 | A1 | 3/2009 | Ogawa | |
| 2011/0216984 | A1 * | 9/2011 | Tezuka | 382/260 |

FOREIGN PATENT DOCUMENTS

| | | | |
|---|---|---|---|
| JP | 63-225871 | A | 9/1988 |
| JP | 5-14724 | A | 1/1993 |
| JP | 2000-127498 | A | 5/2000 |
| JP | 2000-198233 | A | 7/2000 |
| JP | 2003-274176 | A | 9/2003 |
| JP | 2003-316088 | A | 11/2003 |
| JP | 2004-181868 | A | 7/2004 |
| JP | 2004181868 | * | 7/2004 |
| JP | 2007-081657 | A | 3/2007 |
| JP | 2009-130739 | A | 6/2009 |
| WO | 2009/037803 | A1 | 3/2009 |

OTHER PUBLICATIONS

Office Action (Notification of Reasons for Refusal) dated May 21, 2013, issued by the Japanese Patent Office in the corresponding Japanese Patent Application No. 2011-019781 and an English translation thereof. (8 pages).

* cited by examiner

*Primary Examiner* — Laura Martin
*Assistant Examiner* — Carlos A Martinez
(74) *Attorney, Agent, or Firm* — Buchanan Ingersoll & Rooney PC

(57) ABSTRACT

An image forming apparatus having: a light source that emits a beam; a photoreceptor that is scanned with the beam to obtain an electrostatic latent image thereon; and a control unit that determines a light intensity of the beam to be emitted for formation of a pixel, based on a data value for the pixel in image data and data values for its surrounding pixels.

3 Claims, 5 Drawing Sheets

IMAGE FORMING APPARATUS WITH A CONTROL UNIT FOR CONTROLLING LIGHT INTENSITY OF A BEAM USED TO SCAN A PHOTORECEPTOR

This application is based on Japanese Patent Application No. 2011-019781 filed on Feb. 1, 2011, the content of which is incorporated herein by reference.

BACKGROUND OF THE INVENTION

Field of the Invention

The present invention relates to an image forming apparatus, and more particularly to an image forming apparatus that forms an electrostatic latent image by scanning a charged photoreceptor with a beam.

As a conventional image forming apparatus, for example, an image forming apparatus described in Japanese Patent Laid-Open Publication No. 2000-127498 is known. In the image forming apparatus, a beam with an intensity 1 and a beam with an intensity 2 that is higher than the intensity 1 are used to form an electrostatic latent image. The beam with the intensity 1 is used to form a background portion that is not an exposed portion. The beam with the intensity 2 is used to form an exposed portion. Further, in order to improve the contrast, a non-exposed portion is formed between the background portion and the exposed portion.

This and other various inventions have been proposed to improve the contrast of an image.

SUMMARY OF THE INVENTION

An image forming apparatus according to an embodiment of the present invention comprises: a light source that emits a beam; a photoreceptor that is scanned with the beam to obtain an electrostatic latent image thereon; and a control unit that determines a light intensity of the beam to be emitted for formation of a pixel, based on a data value for the pixel in image data and data values for its surrounding pixels; wherein supposing that a maximum light intensity of the beam emitted from the light source is a first light intensity, that a light intensity of the beam emitted from the light source for formation of a pixel in a white solid image is a second light intensity and that a light intensity of the beam emitted from the light source for formation of a pixel in a black solid image is a third light intensity, the control unit controls the light source such that when an image includes a white pixel and a non-white pixel next to each other, the light source emits the beam with a light intensity lower than the second light intensity for formation of the white pixel, and such that when an image includes a black pixel and a non-black pixel next to each other, the light source emits the beam with a light intensity higher than the third light intensity and equal to or lower than the first light intensity for formation of the black pixel.

BRIEF DESCRIPTION OF THE DRAWINGS

This and other objects and features of the present invention will be apparent from the following description with reference to the accompanying drawings, in which.

DETAILED DESCRIPTION OF THE PREFERRED EMBODIMENTS

An image forming apparatus according to an embodiment of the present invention is described.

Structure of the Image Forming Apparatus

Figure 1:
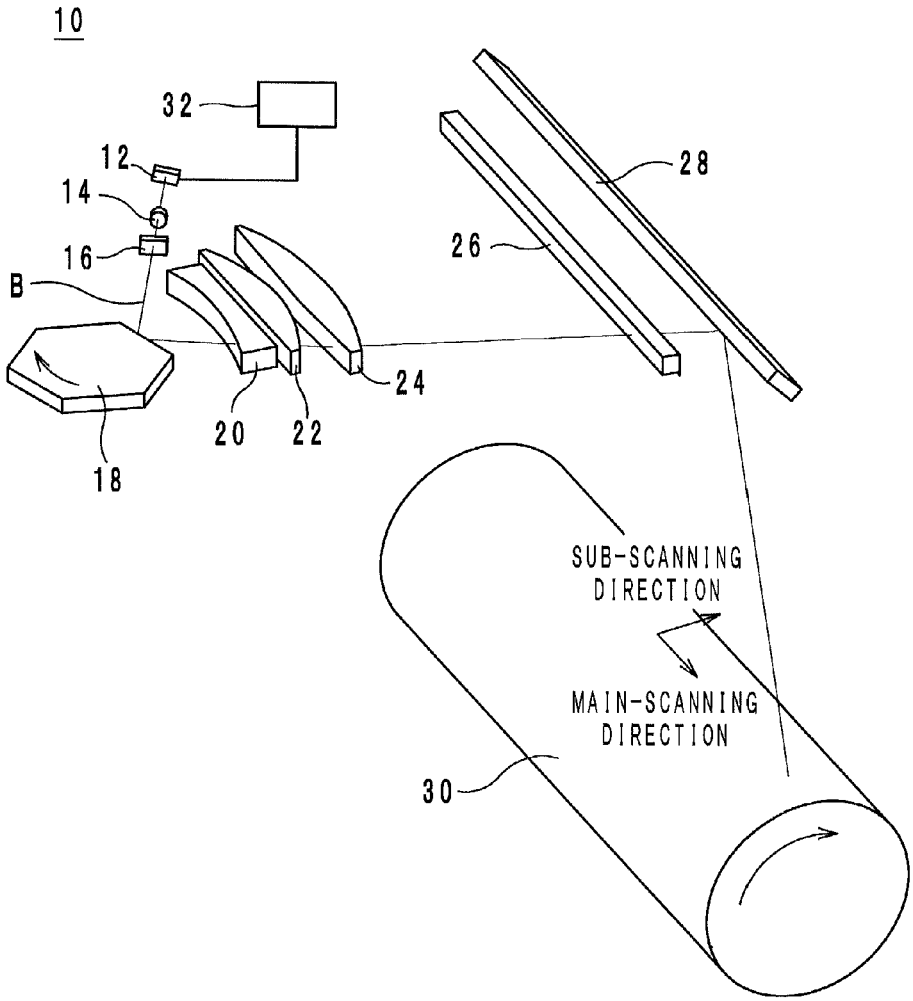
FIG. 1 is a perspective view of an image forming apparatus 10 according to an embodiment of the present invention.

FIG. 1 is a perspective view of the essential part of the image forming apparatus 10 according to the embodiment.

The image forming apparatus 10 comprises a light source 12, a collimator lens 14, a cylindrical lens 16, a deflector 18, scanning lenses 20, 22, 24 and 26, a mirror 28, a photosensitive drum 30, and a control unit 32.

The light source 12 emits a beam B. The collimator lens 14 shapes the beam B emitted from the light source 12 into a substantially parallel light. The cylindrical lens 16 makes the beam B converge into a linear shape on a reflecting surface of the deflector 18.

The deflector 18 comprises a polygon mirror and a motor (not shown) for rotating the polygon mirror, and the deflector 18 deflects the beam B. The scanning lenses 20, 22, 24 and 26 focus the beam B deflected by the deflector 18 onto the peripheral surface of the photosensitive drum 30. The mirror 28 receives and reflects the beam B that has passed through the scanning lens 26 and directs the beam B to the photosensitive drum 30.

The photosensitive drum 30 is cylindrical, and is charged by a charger (not shown). While the peripheral surface of the photosensitive drum 30 is scanned with the beam B in a main scanning direction repetitiously, an electrostatic latent image is formed on the peripheral surface of the photosensitive drum 30.

The control unit 32 controls the whole image forming apparatus 1, and more specifically, controls the light intensity of the beam B emitted from the light source 12.

Control of the Light Source

The process of controlling the light source 12 performed by the control unit 32 is hereinafter described with reference to the drawings. Table 1 shows a filter the control unit 32 uses for image data conversion.

TABLE 1

| | | | | |
|---|---|---|---|---|
| 0 | 0 | −0.05 | 0 | 0 |
| 0 | −0.15 | −0.1 | −0.15 | 0 |
| −0.05 | −0.1 | 2.2 | −0.1 | −0.05 |
| 0 | −0.15 | −0.1 | −0.15 | 0 |
| 0 | 0 | −0.05 | 0 | 0 |

The control unit 32 calculates the light intensity of the beam B for formation of each pixel, from a data value for the pixel in image data and data values for its surrounding pixels in the image data. More specifically, the control unit 32 uses a matrix with a specified element of a number equal to or greater than 1 at a specified location and with elements of negative numbers around the specified element (a filter shown by Table 1) to convert the data value for each pixel in image data into a corrected data value for the pixel. The filter shown by Table 1 is a filter of a matrix of five rows by five columns.

In the filter shown by Table 1, the specified location is the location (3, 3), and the specified element is the element at the center of the filter. In the filter shown by Table 1, elements of negative numbers (−0.05, −0.1, −0.15) are arranged around the specified element located at (3, 3). With respect to the numbers of the elements, the farther from the specified element, the smaller. The numbers of all the elements in the filter sum up to 1. This means that the sum of the light intensities indicated by the image data is equal to the sum of the light intensities indicated by the corrected image data. In the following, the process of converting image data into corrected image data will be described referring to an example. In this embodiment, an element located at (a, b) means the element in the ath row from the top and in the bth column from the left.

Table 2 shows an example of image data. In the example of Table 2, the data values for the pixels are 0 or 1. The data value of 0 shows that the pixel is white, and the data value of 1 shows that the pixel is black. For simple description, in this example, the data values of the pixels are set to 0 or 1. In actual image data, however, the data values are values in accordance with the respective grey levels, for example, 0 to 255. Table 3 shows an example of corrected image data generated by the control unit 32.

TABLE 2

| | | | | | | | | | |
|---|---|---|---|---|---|---|---|---|---|
| 0 | 0 | 0 | 0 | 0 | 0 | 0 | 0 | 0 | 0 |
| 0 | 0 | 0 | 0 | 0 | 0 | 0 | 0 | 0 | 0 |
| 0 | 0 | 0 | 0 | 0 | 0 | 0 | 0 | 0 | 0 |
| 0 | 0 | 0 | 1 | 1 | 1 | 1 | 0 | 0 | 0 |
| 0 | 0 | 0 | 1 | 1 | 1 | 1 | 0 | 0 | 0 |
| 0 | 0 | 0 | 1 | 1 | 1 | 1 | 0 | 0 | 0 |
| 0 | 0 | 0 | 1 | 1 | 1 | 1 | 0 | 0 | 0 |
| 0 | 0 | 0 | 0 | 0 | 0 | 0 | 0 | 0 | 0 |
| 0 | 0 | 0 | 0 | 0 | 0 | 0 | 0 | 0 | 0 |
| 0 | 0 | 0 | 0 | 0 | 0 | 0 | 0 | 0 | 0 |

TABLE 3

| | | | | | | | | | |
|---|---|---|---|---|---|---|---|---|---|
| 0 | 0 | 0 | 0 | 0 | 0 | 0 | 0 | 0 | 0 |
| 0 | 0 | 0 | −0.05 | −0.05 | −0.05 | −0.05 | 0 | 0 | 0 |
| 0 | 0 | −0.15 | −0.3 | −0.45 | −0.45 | −0.3 | −0.15 | 0 | 0 |
| 0 | −0.05 | −0.3 | 1.75 | 1.5 | 1.5 | 1.75 | −0.3 | −0.05 | 0 |
| 0 | −0.05 | −0.45 | 1.5 | 1.1 | 1.1 | 1.5 | −0.45 | −0.05 | 0 |
| 0 | −0.05 | −0.45 | 1.5 | 1.1 | 1.1 | 1.5 | −0.45 | −0.05 | 0 |
| 0 | −0.05 | −0.3 | 1.75 | 1.5 | 1.5 | 1.75 | −0.3 | −0.05 | 0 |
| 0 | 0 | −0.15 | −0.3 | −0.45 | −0.45 | −0.3 | −0.15 | 0 | 0 |
| 0 | 0 | 0 | −0.05 | −0.05 | −0.05 | −0.05 | 0 | 0 | 0 |
| 0 | 0 | 0 | 0 | 0 | 0 | 0 | 0 | 0 | 0 |

The control unit 32 multiplies the data value for a specified pixel with the number of the specified element and multiplies the data values of the pixels around the specified pixel respectively with the numbers of the elements around the specified element. Then, the control unit 32 determines the sum of the values obtained from the multiplications as a corrected data value for the specified pixel. As an example, the process of calculating the corrected data value for the pixel located at (5, 4) in Table 2 is described.

Table 4 shows the data value for the pixel located at (5, 4) and the data values for the surrounding pixels.

TABLE 4

| | | | | |
|---|---|---|---|---|
| 0 | 0 | 0 | 0 | 0 |
| 0 | 0 | 1 | 1 | 1 |
| 0 | 0 | 1 | 1 | 1 |
| 0 | 0 | 1 | 1 | 1 |
| 0 | 0 | 1 | 1 | 1 |

Figure 5:
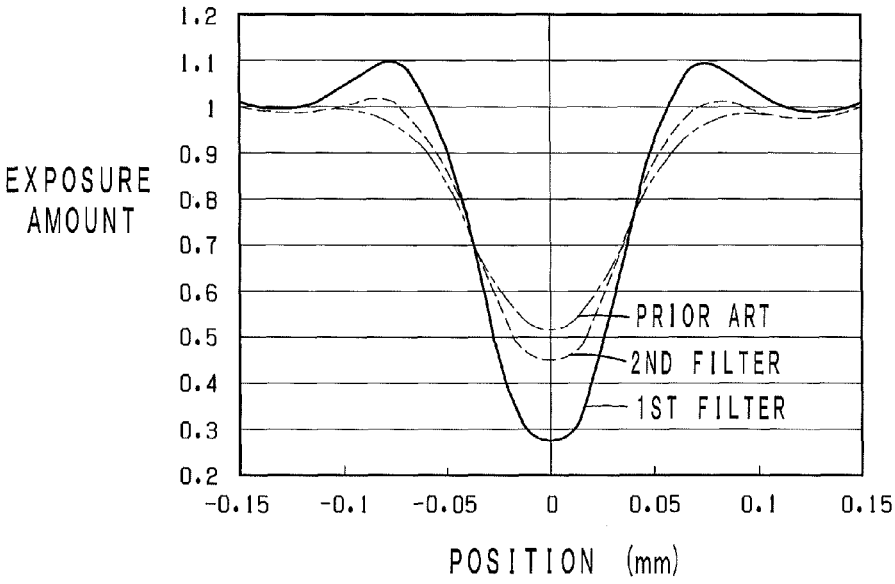
FIG. 5 is a graph showing the contrast of a fourth image.

The control unit 32 multiplies the data value for the pixel located at (5, 4) with the number of the specified element (3, 3). Further, as shown by FIG. 5, the control unit 32 multiplies the data values for the pixels around the pixel located at (5, 4) with the values of the elements around the specified element (3, 3).

TABLE 5

| | | | | |
|---|---|---|---|---|
| 0 × 0 | 0 × 0 | 0 × −0.05 | 0 × 0 | 0 × 0 |
| 0 × 0 | 0 × −0.15 | 1 × −0.1 | 1 × −0.15 | 1 × 0 |
| 0 × −0.05 | 0 × −0.1 | 1 × 2.2 | 1 × −0.1 | 1 × −0.05 |
| 0 × 0 | 0 × −0.15 | 1 × −0.1 | 1 × −0.15 | 1 × 0 |
| 0 × 0 | 0 × 0 | 1 × −0.05 | 1 × 0 | 1 × 0 |

Next, the control unit 32 sums up the values shown in Table 5 and determines the calculated sum as the corrected data value for the pixel located at (5, 4). In this way, the control unit 32 calculates the corrected data value for the pixel located at (5, 4) to be 1.5. The control unit 32 calculates corrected data values for all the pixels in the same way, and thereby, corrected data values as shown by Table 3 are obtained. In edge portions of image data, there are no pixels to be subjected to multiplications with numbers of elements, and the data values in edge portions are considered as 0.

After the calculations of the corrected image data values, the control unit 32 controls the light source 12 such that the light source 12 emits the beam B for formation of the respective pixels with the light intensity adjusted in accordance with the obtained corrected data values for the respective pixels. However, as shown in Table 3, there are some negative values in the corrected image data. The control unit 32 cannot adjust the light intensity of the beam B by using the corrected data values with no change. Therefore, the control unit 32 performs the following calculation.

First, the way of adjusting the light intensity of the beam B emitted from the light source 12 is described. The control unit 32 adjusts the light intensity of the beam B emitted from the light source 21 by changing the time length of light emission from the light source 12 during scanning of one pixel with the beam B, which will be referred to as emission time. More specifically, when the time necessary for scanning of a pixel with the beam B is defined as t1, the maximum light intensity of the beam B emitted from the light source 12 for formation of a pixel is equal to the light intensity of the beam B achieved by setting the emission time to t1. On the other hand, the minimum light intensity of the beam B emitted from the light source 12 for formation of a pixel, that is, the light intensity of 0 is equal to the light intensity of the beam B achieved by setting the emission time to 0. The emission time and the light intensity are in proportional relation with each other.

As will be described below, it should be noted that the corrected data values obtained by using the filter shown by Table 1 are within the range from −1.2 to 2.2. Table 6 shows image data that includes a data value of 1 for the center pixel and data values of 0 for all the other pixels. Table 7 shows image data that includes a data value of 0 for the center pixel and data values of 1 for all the other pixels. The image data shown by Table 6 indicates that there is one black pixel at the center of a white image. The image data shown by Table 7 indicates that there is one white pixel at the center of a black image.

TABLE 6

| | | | | |
|---|---|---|---|---|
| 0 | 0 | 0 | 0 | 0 |
| 0 | 0 | 0 | 0 | 0 |

TABLE 6-continued

| | | | | |
|---|---|---|---|---|
| 0 | 0 | 1 | 0 | 0 |
| 0 | 0 | 0 | 0 | 0 |
| 0 | 0 | 0 | 0 | 0 |

TABLE 7

| | | | | |
|---|---|---|---|---|
| 1 | 1 | 1 | 1 | 1 |
| 1 | 1 | 1 | 1 | 1 |
| 1 | 1 | 0 | 1 | 1 |
| 1 | 1 | 1 | 1 | 1 |
| 1 | 1 | 1 | 1 | 1 |

In the case shown by Table 6, the corrected data value for the pixel located at (3, 3) is calculated to be equal to the number of the element located at (3, 3), which is the maximum value of 2.2. On the other hand, in the case shown by FIG. 7, the corrected data value for the pixel located at (3, 3) is calculated to be equal to the sum of the numbers (negative numbers) of all the elements other than the element (3, 3), which is the minimum value of −1.2.

As described above, when the filter shown by Table 1 is used, the corrected image data includes data values from −1.2 to 2.2. Therefore, for formation of pixels for which the corrected data values are −1.2, the control unit 32 prohibits the light source 12 from emitting the beam B. In other words, the emission times for formation of pixels for which the corrected data values are −1.2 are set to 0 by the control unit 32. On the other hand, for formation of pixels for which the corrected data values are 2.2, the light source 12 is controlled by the control unit 32 to emit the beam B with the maximum light intensity. In other words, the emission times for formation of pixels for which the corrected data values are 2.2 are set to t1.

The control unit 32 controls the light source 12 such that the larger the corrected data value, the higher the light intensity of the beam B. More specifically, when the corrected data value for a pixel is x, the control unit 32 sets the emission time for formation of the pixel to t1×(x+1.2)/(2.2+1.2).

In the image forming apparatus 10 according to the present embodiment, when all the data values in image data are 1, which indicates a black solid image in the case of binary image data wherein only two values 0 and 1 are used, all the corrected data values are calculated to be 1. In this case, the emission times for formation of all the pixels are set to t1×(1+1.2)/(2.2+1.2). Thus, in the image forming apparatus 10, the beam B emitted for formation of the pixels in a black solid image does not have the maximum intensity. This arrangement is made in consideration for the following case. When there is a non-black pixel (a white pixel in the case of binary image data) next to a black pixel, it is necessary to lay weight on the black pixel in order to improve the contrast between the black pixel and the white pixel. In this case, therefore, the control unit 32 controls the light source 12 such that for formation of the black pixel, the light source 12 emits the beam B with a light intensity that is higher than the light intensity emitted for formation of the pixels in a black solid image and is lower than the maximum light intensity achieved by the light source 12.

In the image forming apparatus 10, also, when the data values for all the pixels are 0, which indicates a white solid image in the case of binary image data wherein only two values 0 and 1 are used, all the corrected data values are calculated to be 0. In this case, the emission times for all the pixels are set to t1×(0+1.2)1(2.2+1.2). Thus, in the image forming apparatus 10, the light intensity of the beam B emitted for formation of the pixels in a white solid image is not 0. This arrangement is made for consideration for the following case. When there is a non-white pixel, which means a black pixel in the case of binary image data, next to a white pixel, it is necessary to lay weight on the white pixel in order to improve the contrast between the black pixel and the white pixel. In this case, therefore, the control unit 32 controls the light source 12 such that for formation of the white pixel, the light source 12 emits the beam B with a light intensity that is lower than the light intensity emitted for formation of the pixels in a white solid image. Hence, the minimum light intensity of the beam B emitted from the light source 12 during formation of an image with white pixels and black pixels mixed together is lower than the light intensity of the beam B for formation of the pixels of a white solid image.

ADVANTAGES

The image forming apparatus 10 of the structure above can form images with improved contrast. In the image forming apparatus 10, the control unit 32 converts image data into corrected image data by using the filter shown by Table 1. The filter shown by Table 1 has an element of a number equal to or greater than 1 at the location (3, 3) and has elements of negative numbers at locations around the location (3, 3). By using this filter, a white pixel next to a black pixel is formed to be whiter than a white pixel in a white solid image, and a black pixel next to a white pixel is formed to be blacker than a black pixel in a black solid image. Consequently, the contrast between a white pixel and a black pixel next to each other is improved.

When the filter shown by Table 1 is used to generate corrected image data, the corrected image data possibly includes negative data values. In the image forming apparatus 10, therefore, the control unit 32 prohibits the light source 12 from emitting the beam B for formation of pixels for which the corrected data values are equal to the sum of the negative numbers in the filter (−1.2 in this embodiment). The control unit 32 makes the light source 12 emit the beam B with the maximum light intensity for formation of pixels for which the corrected data values are equal to the number of the specified element (2.2 of the element (3, 3) in this embodiment). The control unit 32 also controls the light source 12 such that the larger the corrected data value, the higher the light intensity of the beam B. With this arrangement, even when the corrected data value is negative, emission of the beam B is possible.

The filter that can be used in the image forming apparatus 10 is not limited to the filter shown by Table 1. Table 8 shows a modified filter. While the filter shown by Table 1 consists of five rows and five columns, the filter shown by Table 8 consists of three rows and three columns. By using the filter shown by Table 8, also, the image forming apparatus 10 can form images with improved contrast.

TABLE 8

| | | |
|---|---|---|
| 0 | −0.15 | 0 |
| −0.15 | 1.6 | −0.15 |
| 0 | −0.15 | 0 |

Experimental Results

The inventors conducted experiments as described below so as to make sure the image forming apparatus 10 has the advantages. More specifically, the following first to eighth types of images were formed by the image forming apparatus 10 having the filter shown by Table 1 (which will be hereinafter referred to as a first filter), by the image forming apparatus 10 having the filter shown by Table 8 (which will be hereinafter referred to as a second filter) and by an image forming apparatus having neither the first filter nor the second filter (which will be hereinafter referred to as an image forming apparatus of prior art), and the contrast of the formed images was examined.

The first type of image was an image with only one black pixel in the center of a white image;

the second type of image was an image with only one white pixel in the center of a black image;

the third type of image was an image that has a black vertical line with a one-pixel width in a white image;

the fourth type of image was an image that has a white vertical line with a one-pixel width in a black image;

the fifth type of image was an image that has a black horizontal line with a one-pixel width in a white image;

the sixth type of image was an image that has a white horizontal line with a one-pixel width in a black image;

the seventh type of image was an image that has a black oblique line inclining at 45 degrees with a one-pixel width in a white image; and the eighth type of image was an image that has a white oblique line inclining at 45 degrees with a one-pixel width in a black image.

FIGS. 2 to 9 are graphs showing the contrast of the first to eighth types of images. The y axis shows the exposure amount, and the x axis shows the position on the photosensitive drum 30. The exposure amount is shown by relative values. The pixel density was 600 dpi.

Figure 2:
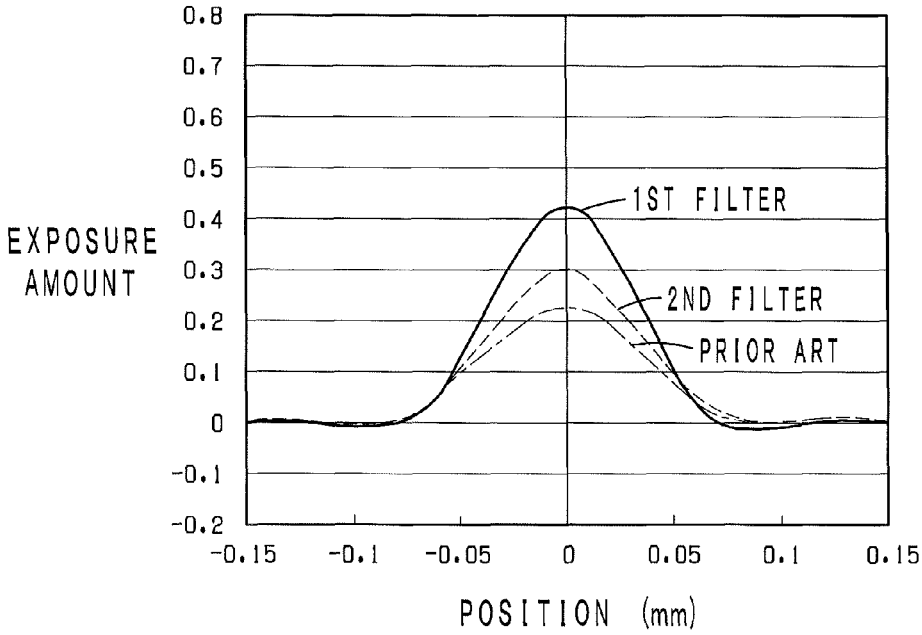
FIG. 2 is a graph showing the contrast of a first image.

As is apparent from FIG. 2, only the portion with a one-pixel width of the photosensitive drum 30 was exposed. In the image forming apparatus 10 having the first filter and in the image forming apparatus 10 having the second filter, the exposure amount of the portion around the position of 0 mm was higher than that in the image forming apparatus of prior art. Thus, the images of the first type formed by the image forming apparatus 10 having the first filter and by the image forming apparatus 10 having the second filter were improved in contrast.

In the image forming apparatus 10 having the first filter, the exposure amounts of the portions around the positions of ±0.1 mm were smaller than that of the portion higher than the position of 0.1 mm and that of the portion lower than the position of −0.1 mm. Therefore, when the first type of image is formed by the image forming apparatus 10 having the first filter, an adverse effect that carriers of a developer adhere to the portions around the positions of ±0.1 mm possibly occurs, although it depends on the structure of the developing device.

In the image forming apparatus 10 having the second filter, the exposure amounts of the portions around the positions of ±0.1 mm were not smaller than that of the portion higher than the position of 0.1 mm and that of the portion lower than the position of −0.1 mm. Therefore, when the first type of image is formed by the image forming apparatus 10 having the second filter, the possibility of having the adverse effect in the portions around the positions of ±0.1 mm is lower than the possibility of having the adverse effect when the first type of image is formed by the image forming apparatus 10 having the first filter.

Figure 3:
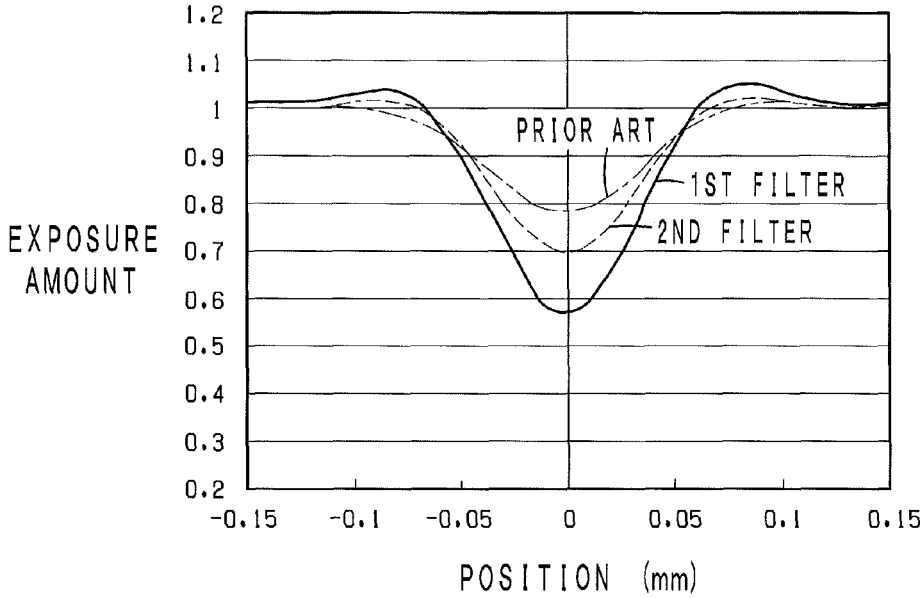
FIG. 3 is a graph showing the contrast of a second image.

As is apparent from FIG. 3, the images of the second type formed by the image forming apparatus 10 having the first filter and by the image forming apparatus 10 having the second filter were improved in contrast, compared with the image of the second type formed by the image forming apparatus of prior art.

Figure 4:
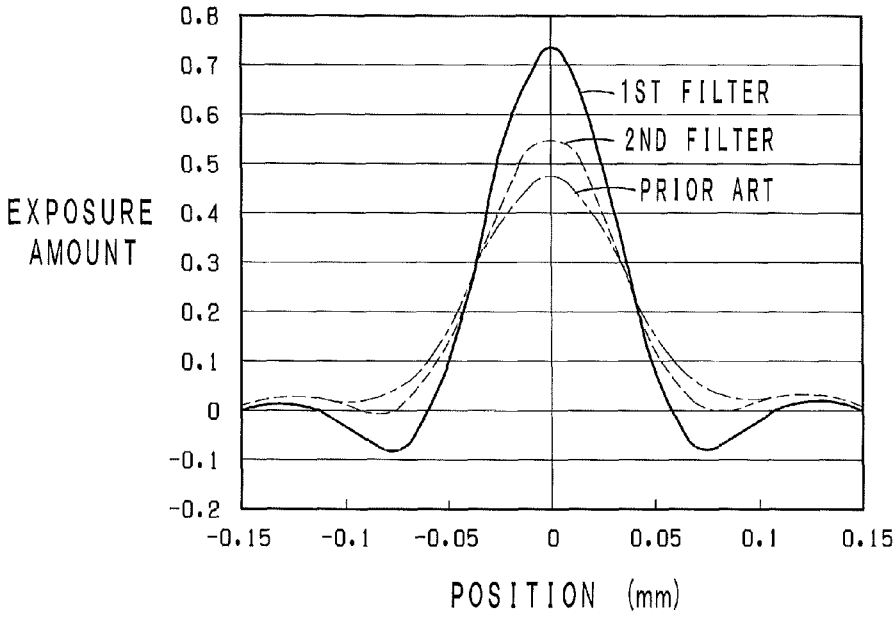
FIG. 4 is a graph showing the contrast of a third image.

In the graph of FIG. 4, the x axis shows the position in the main-scanning direction. Although not shown, with respect to all the points along the vertical black line, the same results as shown by FIG. 4 were obtained. These results show that the images of the third type formed by the image forming apparatus 10 having the first filter and by the image forming apparatus 10 having the second filter were improved in contrast, compared with the image of the third type formed by the image forming apparatus of prior art.

In the graph of FIG. 5, the x axis shows the position in the main-scanning direction. Although not shown, with respect to all the points along the vertical white line, the same results as shown by FIG. 5 were obtained. These results show that the images of the fourth type formed by the image forming apparatus 10 having the first filter and by the image forming apparatus 10 having the second filter were improved in contrast, compared with the image of the fourth type formed by the image forming apparatus of prior art.

Figure 6:
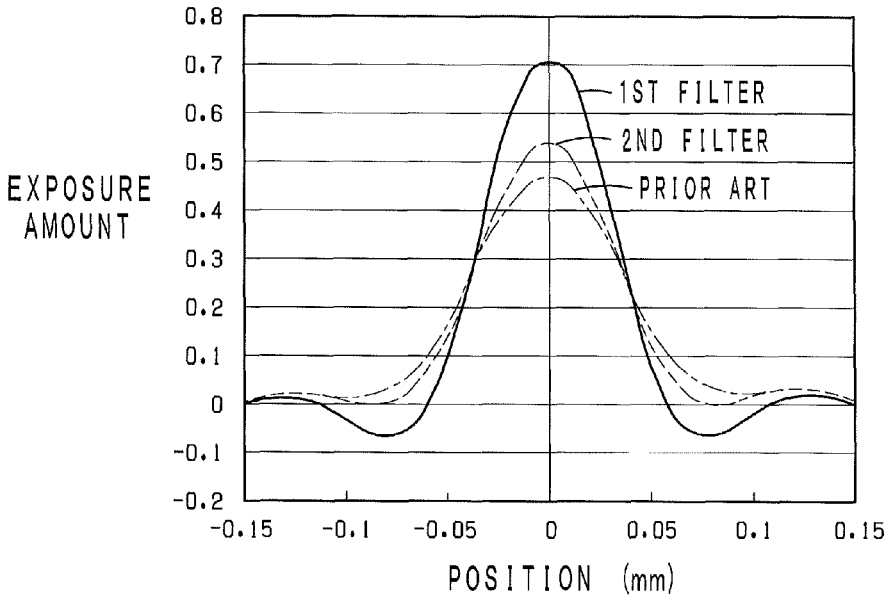
FIG. 6 is a graph showing the contrast of a fifth image.

In the graph of FIG. 6, the x axis shows the position in the sub-scanning direction. Although not shown, with respect to all the points along the horizontal black line, the same results as shown by FIG. 6 were obtained. These results show that the images of the fifth type formed by the image forming apparatus 10 having the first filter and by the image forming apparatus 10 having the second filter were improved in contrast, compared with the image of the fifth type formed by the image forming apparatus of prior art.

Figure 7:
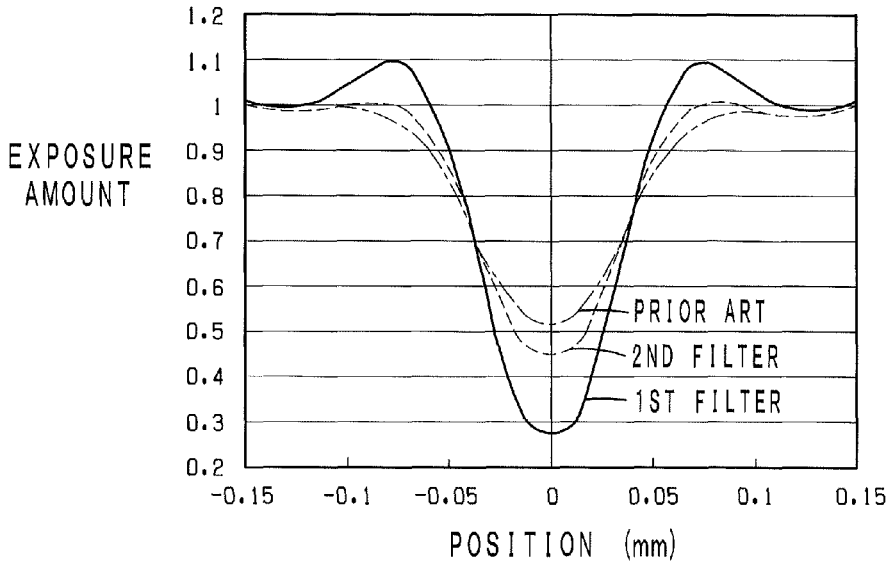
FIG. 7 is a graph showing the contrast of a sixth image.

In the graph of FIG. 7, the x axis shows the position in the sub-scanning direction. Although not shown, with respect to all the points along the horizontal white line, the same results as shown by FIG. 7 were obtained. These results show that the images of the sixth type formed by the image forming apparatus 10 having the first filter and by the image forming apparatus 10 having the second filter were improved in contrast, compared with the image of the sixth type formed by the image forming apparatus of prior art.

Figure 8:
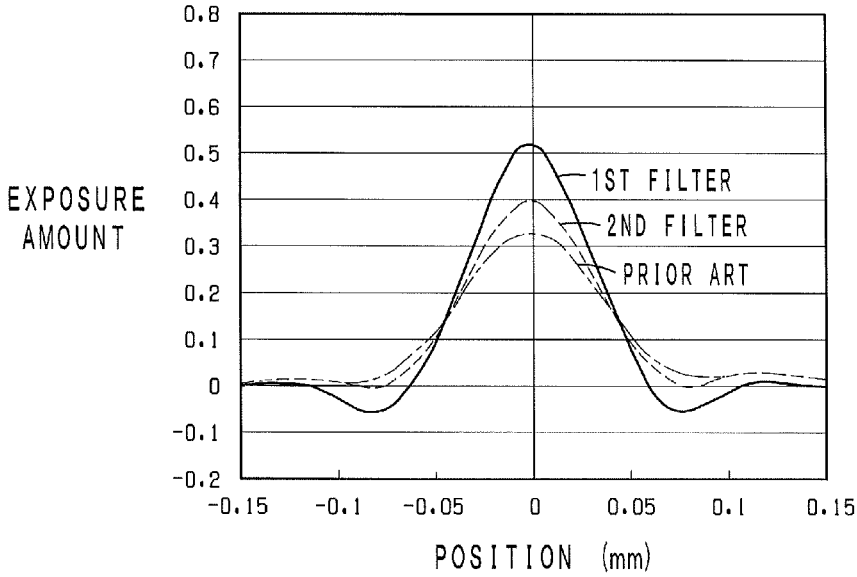
FIG. 8 is a graph showing the contrast of a seventh image.

In the graph of FIG. 8, the x axis shows the position in the direction orthogonal to the oblique line. Although not shown, with respect to all the points along the oblique black line, the same results as shown by FIG. 8 were obtained. These results show that the images of the seventh type formed by the image forming apparatus 10 having the first filter and by the image forming apparatus 10 having the second filter were improved in contrast, compared with the image of the seventh type formed by the image forming apparatus of prior art.

However, compared with the images of the third type, the images of the seventh type were not good in contrast. The reason is as follows. The oblique line in the seventh type image was written by writing one dot in each sub-scanning line with one dot shifted in the main-scanning direction, and the width of the oblique line in the direction orthogonal to the oblique line was $1/\sqrt{2}$ times as large as the width of the vertical line in the third type image.

Figure 9:
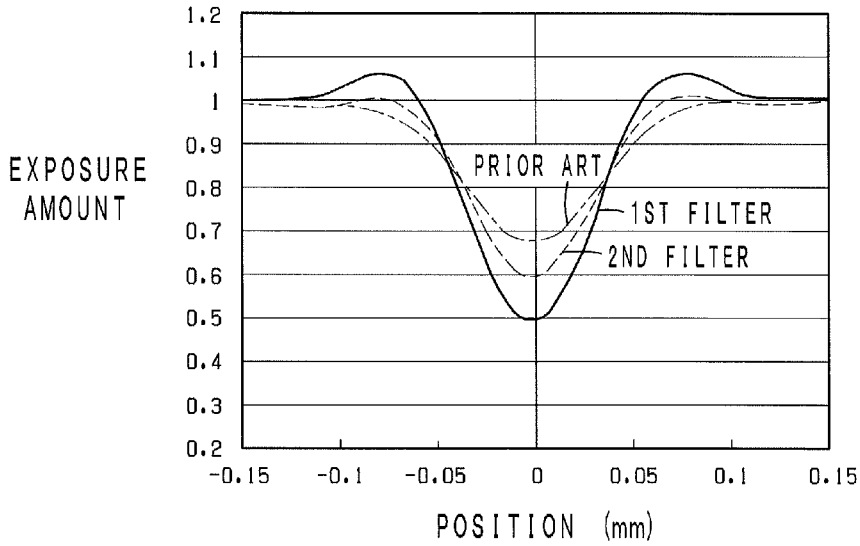
FIG. 9 is a graph showing the contrast of an eighth image.

In the graph of FIG. 9, the x axis shows the position in the direction orthogonal to the oblique line. Although not shown, with respect to all the points along the oblique white line, the same results as shown by FIG. 9 were obtained. These results show that the images of the eighth type formed by the image forming apparatus 10 having the first filter and by the image forming apparatus 10 having the second filter were improved in contrast, compared with the image of the eighth type formed by the image forming apparatus of prior art.

However, compared with the images of the fourth type, the images of the eighth type were not good in contrast. The reason is as follows. The oblique line in the eighth type image was written by writing one dot in each sub-scanning line with one dot shifted in the main-scanning direction, and the width of the oblique line in the direction orthogonal to the oblique line was $1/\sqrt{2}$ times as large as the width of the vertical line in the fourth type image.

Although the present invention has been described with reference to the preferred embodiment above, it is to be noted that various changes and modifications are possible to those who are skilled in the art. Such changes and modifications are to be understood as being within the scope of the invention.

What is claimed is:

1. An image forming apparatus comprising:

a light source that emits a beam;

a photoreceptor that is scanned with the beam to obtain an electrostatic latent image thereon; and a control unit that determines a light intensity of the beam to be emitted for formation of a pixel, based on a data value for the pixel in image data and data values for its surrounding pixels;

wherein when a maximum light intensity of the beam emitted from the light source is a first light intensity, a light intensity of the beam emitted from the light source for formation of a pixel in a white solid image is a second light intensity, and a light intensity of the beam emitted from the light source for formation of a pixel in a black solid image is a third light intensity, the control unit controls the light source such that when an image includes a white pixel and a non-white pixel next to each other, the light source emits the beam with a light intensity lower than the second light intensity for formation of the white pixel, and such that when an image includes a black pixel and a non-black pixel next to each other, the light source emits the beam with a light intensity higher than the third light intensity and equal to or lower than the first light intensity for formation of the black pixel.

2. An image forming apparatus according to claim 1, wherein the control unit adjusts the light intensity of the beam by changing a time length of emission from the light source.

3. An image forming apparatus according to claim 1, wherein the control unit control the light source such that a minimum light intensity of the beam to form an image including white pixels and black pixels is equal to or lower than the second light intensity.

* * * * *